US009858838B1

(12) United States Patent
Auble

(10) Patent No.: US 9,858,838 B1
(45) Date of Patent: Jan. 2, 2018

(54) FAN STICK

(71) Applicant: Christopher Auble, Kailua-Kona, HI (US)

(72) Inventor: Christopher Auble, Kailua-Kona, HI (US)

( * ) Notice: Subject to any disclaimer, the term of this patent is extended or adjusted under 35 U.S.C. 154(b) by 0 days.

(21) Appl. No.: 15/422,790

(22) Filed: Feb. 2, 2017

(51) Int. Cl.
*G09F 17/00* (2006.01)
*G09F 19/02* (2006.01)

(52) U.S. Cl.
CPC ..... *G09F 17/00* (2013.01); *G09F 19/02* (2013.01)

(58) Field of Classification Search
CPC ..... G09F 17/00; G09F 21/02
USPC ..... 40/218
See application file for complete search history.

(56) References Cited

U.S. PATENT DOCUMENTS

| | | | |
|---|---|---|---|
| 5,904,116 | A | 5/1999 | Wyner |
| 8,082,687 | B2 | 12/2011 | Cohen |
| 8,136,209 | B1 | 3/2012 | Willison |
| 8,257,135 | B2 | 9/2012 | Arcovio |
| 2013/0180083 | A1 | 7/2013 | Walker |
| 2013/0205625 | A1 | 8/2013 | Pilok |
| 2014/0273720 | A1 | 9/2014 | DiNunzio |

*Primary Examiner* — Shin Kim

(57) ABSTRACT

An apparatus for spinning a rally towel comprising a body section comprising with a first end and a second end, an outer housing extending from the first end to the second end with the outer housing having knobs at the second end, an inner cylindrical tube, at least a pair of spheres comprising a first attaching means, a second attaching means, a gripping means, a noise creating means, and a towel such that the towel is inserted in corners of said spheres between said gripping means with said second attaching means in closed position for the insertion. Further the apparatus provided plastic noise knobs that create clicking noise when flap comes in contact with plastic noise knobs. The apparatus is used as a cheering device for fans to twirl around during a sport to support the respective favorite team.

17 Claims, 4 Drawing Sheets

FAN STICK

CROSS REFERENCE TO RELATED APPLICATION

Not Applicable

FEDERALLY SPONSORED RESEARCH AND DEVELOPMENT

Not Applicable

MICROFICHE APPENDIX

Not Applicable

BACKGROUND OF THE INVENTION

(1) Field of the Invention

The present invention relates to the field of the sporting goods, and more particularly the invention relates to the rally towel spinning apparatus to aid user in smooth twirling of the towel during the game.

(2) Background of the Invention

Spectators and sport lovers prefer to support their favorite teams in their own unique style, by wearing same colored jerseys, hats, shades, painting their faces with their favorite team's flag or color, wearing bracelets etc. All these are conventional types of cheerleading devices that are used for fun and supporting and motivating respective teams. A common way of cheerleading is the use of rally towels with printed logo's and taglines for favorite teams. Fans feel like enjoying and cheering their teams by twirling these rally towels, high enough in chorus together to motivate and support the desired team.

Various prior arts in the past support the use of rally towels as a means for cheering their favorite teams. Like, prior art, Patent No. US 20130180083 A1 discloses a rally towel apparatus comprising a body having a first end and a second end. The rally towel apparatus also comprises a first end cap engaged with a first end and a second end cap engaged with a second end. The rally towel apparatus also comprises a cord connected to the first end cap and a cord lock member arranged on the cord. The rally towel apparatus also comprises a wrist strap connected to the second end cap and a rally towel arranged and secured within a loop of the cord.

Similarly, another prior art, U.S. Pat. No. 8,257,135 B2 discloses a spinning towel assembly, a rally towel spins about an axis and is adapted to be handheld for use at sporting events or other gatherings. The towel has a shape of an airfoil with a leading edge that is thicker than a trailing edge for improved lift and longer duration of rotation about the axis. Another rally towel device is disclosed in Patent No. US 20140273720 A1, constituting a rally towel device that has an inner cylindrically shaped tube and an outer cylindrically shaped tube extending over the inner tube. It provides a simple rally towel device which fixedly supports a rally towel, while allowing the user to easily and continuously wave the towel faster and longer with less effort.

Likewise, many other prior arts also discloses spinning towel assembly including U.S. Pat. No. 8,136,209 B1; US 20130205625 A1; U.S. Pat. No. 8,082,687 B2 and U.S. Pat. No. 5,904,116 A. Accordingly, a need exists for an improved rally towel which can be easily revolved over the head of a user, preventing wrapping around hands or like, and which clearly displays the colors, logos and other indicia desired in a manner which is readily observable by other spectators and by the performers at a sporting event. Such a rally towel would be lightweight, easily and safely used, and sized appropriately to not interfere with the enjoyment of other spectators nearby.

SUMMARY

There has been summarized above, rather broadly, the prior art that is related to the present invention in order that the context of the present invention may be better understood and appreciated. In this regard, it is instructive to also consider the objects and advantages of the present invention.

In view of the foregoing applications inherent in the known types of rally towel apparatus present in the prior art, the present invention provides a rally towel apparatus with an improved spinning mechanism, wherein user attaches or clips towel to prevent wrapping of the towel around hand while making noise. As such, the general purpose of the present invention, which will be described subsequently in greater detail, is to provide improved apparatus for using with a rally towel, which has all the advantages of the prior art and none of the disadvantages.

Accordingly, a primary object of the present invention is to provide an improved rally towel apparatus.

It is also an object of the present invention to provide a rally towel apparatus for spinning a rally towel having a body section including: a first end and a second end; an outer housing extending from the first end to the second end with the outer housing having knobs at the second end and an inner cylindrical tube. Further the towel holding end of the apparatus is having at least a pair of spheres with a first attaching means, a second attaching means, a gripping means, and a noise creating means.

It is also an object of the present invention to provide a rally towel apparatus capable of being used as a carrying device or a hand grip for rally towel.

It is another object of the present invention to provide a simple rally towel apparatus that supports the rally towel and allows the user to spin the towel easily on same axis of the apparatus with minimum effort.

It is also an object of the present invention to provide a simple rally towel device that support the rally towel and prevent wrapping of the rally towel around hand.

It is further an object of the present invention to provide a rally towel with imprints of a flag, sports logo, symbol, images and their combinations thereof and is in different colors.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

To further clarify various aspects of some example embodiments of the present invention, a more particular description of the invention will be rendered by reference to specific embodiments thereof which are illustrated in the appended drawing. It is appreciated that the drawing depicts only illustrated embodiments of the invention and are therefore not to be considered limiting of its scope. The invention will be described and explained with additional specificity and detail through the use of the accompanying drawing in which.

DETAILED DESCRIPTION OF THE INVENTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

The present invention provides a rally towel spinning apparatus to allow the user to use the towel for waving and cheering for their favorite teams in sports. The purpose of the invention is to provide a user friendly apparatus for easily using the rally towel using the apparatus thereof.

Figure 1:
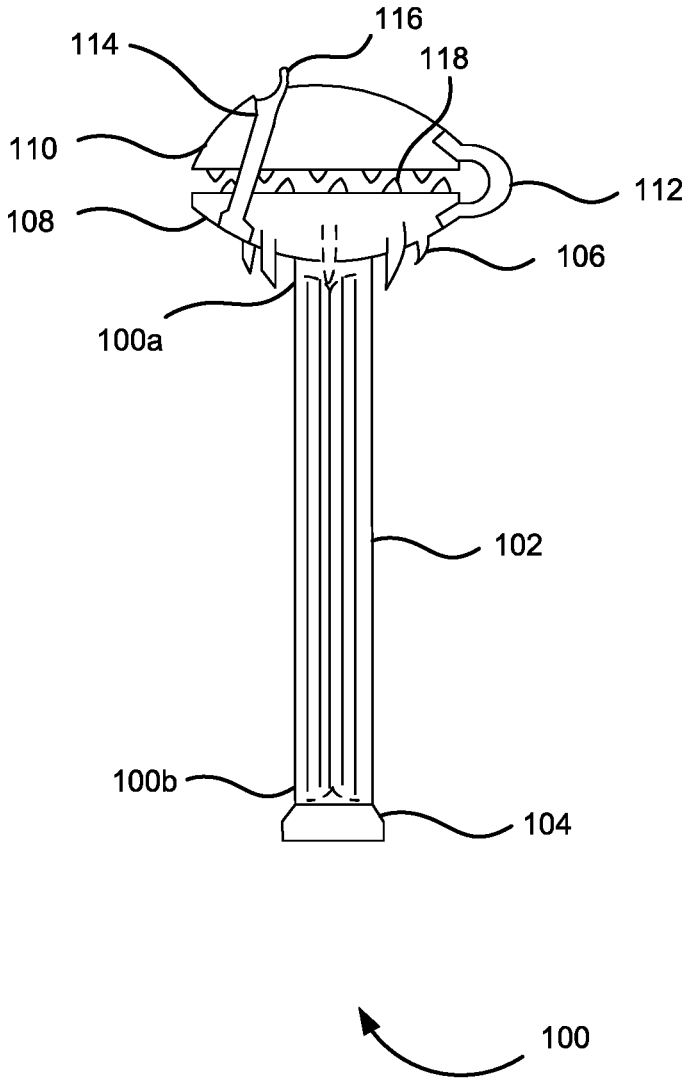
FIG. 1 is a side view of a rally towel apparatus.
Figure 2:
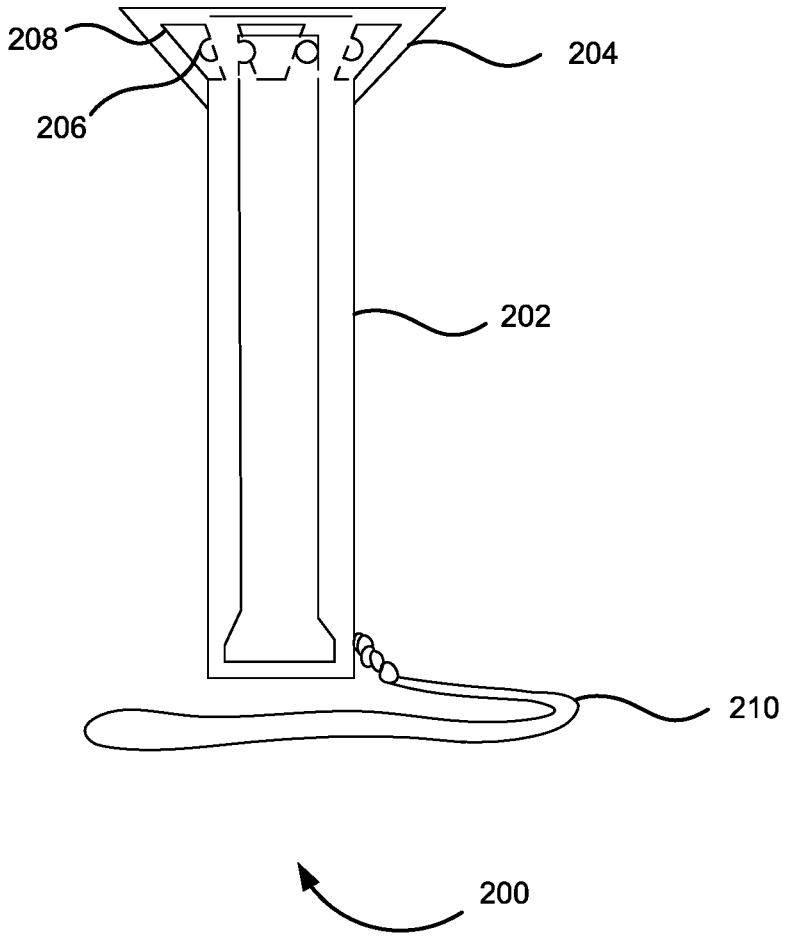
FIG. 2 is a side view of an outer cylinder of the rally towel apparatus.
Figure 3:
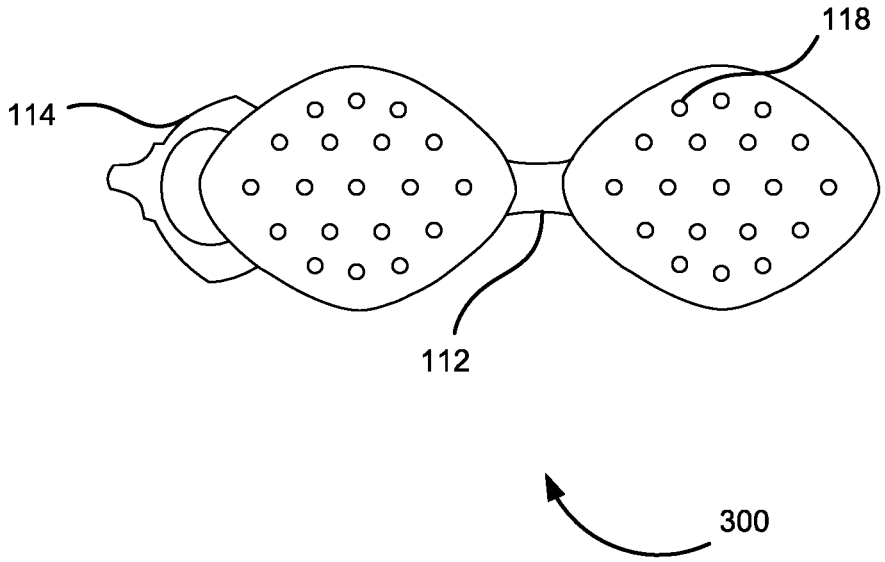
FIG. 3 is a top view of spheres in an open position according to the preferred embodiment of the present invention.

Referring now to the drawings, wherein like reference characters designate identical or corresponding parts throughout the figures, and in particular FIGS. 1, 2 & 3 show various embodiments of the rally towel spinning apparatus in accordance with the present invention.

FIG. 1 shows a side view of a rally towel apparatus 100. The rally towel apparatus 100 includes at least a pair of spheres with an upper sphere 110, a lower sphere 108 and an inner stem 102. The inner stem 102 extends from a first end 100*a* to a second end 100*b* of the rally towel apparatus 100. The upper sphere 110 includes one or more towel grips 118. The lower sphere 108 includes one or more noise creating means 106 and the one or more gripping means 118. The upper sphere 110 is connected to the lower sphere 108 with the help of a first attaching means 112 and a second attaching means 114. The first attaching means 112 connects the upper sphere 110 to the lower sphere 108 at one end. The second attaching means 114 connects the upper sphere 110 to the lower sphere 108 at other end. The second attachment means 114 includes a lift tab 116 for easily lifting and holding the upper sphere 110 and the lower sphere 108. In one embodiment, the first attaching means 112 is a hinge. In other embodiment, the second attaching means 114 is a latch. The purpose of the first attaching means 112 is to hold the upper sphere 110 and the lower sphere 108 together during process of placing the towel and removing it. The purpose of the second attaching means 114 is to secure the towel inside the upper sphere 110 and the lower sphere 108. In one embodiment, the noise creating means 106 are noise flaps.

FIG. 2 is a side view of an outer housing 200 of the rally towel apparatus 100. The outer housing 200 includes an outer stem 202, a guard 204, one or more slots 208 and a leash 210. The guard 204 includes one or more knobs 206. The guard portion 204 prevents a user with large or gloved hand from interfering as the noise creating means 106 rotate across the one or more knobs 206. The guard 202 includes one or more open slots 208 to allow the clicking sound of resonate. The leash 210 is connected to the lower portion of the outer cylinder 200 to secure device to the wrist. In one embodiment, the outer housing 200 is in cylindrical shape.

Further, FIG. 3 illustrates a top view 300 of a pair of spheres in an open position. The top view 300 of the pair of spheres in an open position includes the first attaching means 112, the second attaching means 114 and the gripping means 118. In one embodiment, the first attaching means 112 and second attaching means 114 are made of plastic. In other embodiment, the first attaching means 112 and second attaching means 114 could be selected from a group of latch, bolt, hinges, bar or their combination thereof.

Figure 4:
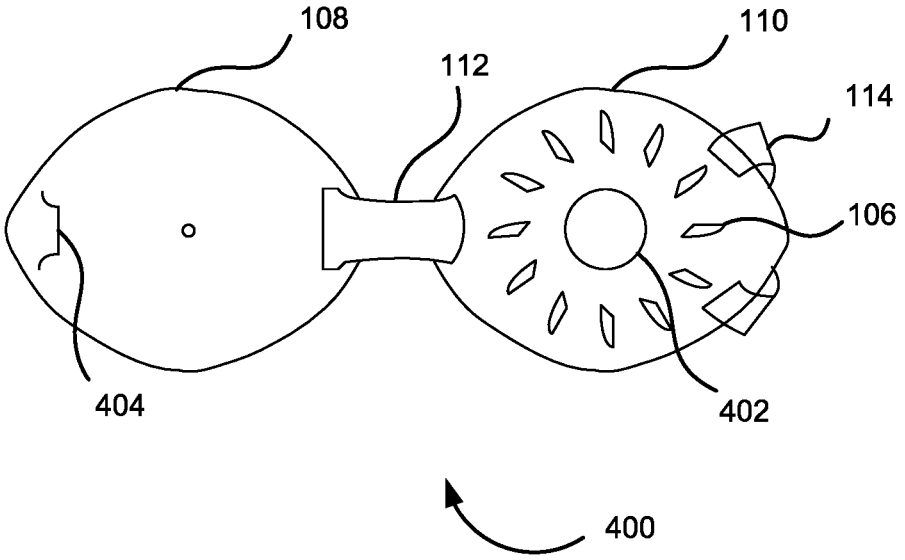
FIG. 4 is a bottom view of the spheres in an open position according to the preferred embodiment of the present invention.

Further, FIG. 4 illustrates a bottom view 400 of the pair of spheres in the open position including, the upper sphere 110 and the lower sphere 108, the first attaching means 112, the second attaching means 114, the one or more noise flaps 106, a central hub 402 and a latch catch 404.

The gripping means 118 as shown in FIG. 1 is provided between the upper sphere 110 and the lower sphere 108 to tightly and securely hold or grip the rally towel and is affixed between the upper sphere 110 and the lower sphere 108, while the user is using the apparatus for twirling the rally towel and cheering for the favorite team in any particular sport. The provided gripping section 118 is an improved way of holding the towel within the apparatus of the invention without losing the grip of the towel during the whole match, as while twirling the rally towel in a huge crowd, in middle of fun and excitement. It has been seen usually that the fan tend to drop or loose the rally towel while waving and cheering for the respective team in. While the towel is gripped within the upper sphere 110 and lower sphere 108, the first attaching means 112 is kept closed for ensured grip and security, wherein the upper sphere 110 and lower sphere 108 acts as clamps provided with small grips of the gripping section 118 to hold the snug. Therefore, the towel is inserted in corners of the upper spheres 110 and the lower sphere 108 between the gripping means 118 with the second attaching means 114 in closed position for securely facilitating the insertion.

In its preferred embodiment, the present invention provides an improved rally towel apparatus that includes a rally towel attached within the spheres at the second end of the hand grip or body section. The towel is attached to the apparatus in a manner which allows the rally towel to revolve around the handle without interfering against the handle allowing the rally towel to revolve indefinitely in either a clockwise or anti-clockwise direction about the handle without wrapping.

Further in an exemplary embodiment of the invention the rally towel apparatus 100 is provided with dimensions 4" long body section with ¼"×¼" inner stem hub, 2"×½"×1¼" inches upper sphere 110 and lower sphere 108, an approximate ¼" gap between the upper sphere 110 and the lower sphere 108, to accommodate the gripping means 118. The loose fitted outer cylinder 202 is provided with ⅛" round one or more knobs 206 at the top to create clicking noise from noise flaps 106. The rally towel apparatus works on wrist activated propulsion, spinning freely clockwise or anticlockwise, thus preventing wrapping around the handle because of inertia that will hold towel away from free floating blend grip. Further in a preferred embodiment of the invention the towel used is a towel. Typically, the rally towel will have an imprinted image on the surface of the towel including imprints of a flag, sports logo, symbol, images and their combinations thereof and is available in different colors based on the user's preference.

The invention is a spinning rally towel assembly that may be used or sold at sporting events, corporate events, or other gatherings to allow fans to spin towels easily and effectively and thereby demonstrate their support for their team or group. As discussed above, the spinning towel assembly may be customized to relate to a particular sport or a particular team or to include sponsor information or other advertisement. The body section is a hand grip for carrying the towel. The one or more knobs create a clicking sound. The rally towel apparatus prevents wrapping around of the towel on the body section. The rally towel apparatus spins the towel effortlessly at the axis same as the rally towel apparatus. The rally towel includes the imprints of a flag, sports logo, symbol, images and combinations thereof.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

I claim:

1. An apparatus for spinning a rally towel comprising:
a first end;
a second end;
an outer housing extending from said first end to said second end, wherein said outer housing comprises:
a guard, wherein said guard comprises a plurality of knobs; and
a leash extending out of said second end of said outer cylinder;
an inner stem; and
a pair of spheres, wherein said pair of spheres comprises:
a first attaching means;
a second attaching means;
a gripping means; and
a noise creating means;
wherein said rally towel is inserted in corners of said pair of spheres between said gripping means with said second attaching means in closed position for said insertion.

2. The apparatus for spinning a rally towel as claimed in claim 1, wherein said inner stem is covered by said outer housing creating a concentric hub to securely carry said rally towel.

3. The apparatus for spinning a rally towel as claimed in claim 1, wherein said outer housing is free floating cylinder around said inner stem.

4. The apparatus for spinning a rally towel as claimed in claim 1, wherein said inner stem comprises a stem hub.

5. The apparatus for spinning a rally towel as claimed in claim 1, wherein said pair of spheres is an upper sphere and a lower sphere.

6. The apparatus for spinning a rally towel as claimed in claim 1, wherein said pair of spheres is held together with said first attaching means and said second attaching means.

7. The apparatus for spinning a rally towel as claimed in claim 1, wherein said second attaching means is selected from a group of latch, bolt, hinges, bar or combination thereof.

8. The apparatus for spinning a rally towel as claimed in claim 1, wherein said second attaching means is hinge.

9. The apparatus for spinning a rally towel as claimed in claim 8, wherein said hinges are made up of plastic.

10. The apparatus for spinning a rally towel as claimed in claim 1, wherein said first attaching means is selected from a group of latch, bolt, hinges, bar or combination thereof.

11. The apparatus for spinning a rally towel as claimed in claim 10, wherein said first attaching means is a latch.

12. The apparatus for spinning a rally towel as claimed in claim 11, wherein said latch is made up of plastic.

13. The apparatus for spinning a rally towel as claimed in claim 1, wherein said noise creating means are hanging from said lower sphere casted onto said inner cylindrical tube.

14. The apparatus for spinning a rally towel as claimed in claim 1, wherein said noise creating means are a plurality of flaps.

15. The apparatus for spinning a rally towel as claimed in claim 1, wherein said gripping means hold said towel securely within said spheres.

16. The apparatus for spinning a rally towel as claimed in claim 1, wherein said plurality of knobs and said noise creating means are made up of plastic.

17. An apparatus for spinning a rally towel comprising:
a first end;
a second end;
an outer housing extending from said first end to said second end, wherein said outer housing comprises:
a guard, wherein said guard comprises a plurality of knobs; and
a leash extending out of said second end of said outer cylinder;
an inner stem; and
an upper sphere and a lower sphere comprises:
a plastic hinge;
a plastic latch;
a gripping means; and
a noise creating means;
wherein a towel is inserted in corners of said pair of spheres between said gripping means with said second attaching means in closed position for said insertion.

* * * * *